US006698103B2

(12) United States Patent
Nortier et al.

(10) Patent No.: US 6,698,103 B2
(45) Date of Patent: Mar. 2, 2004

(54) FLUSH VALVE MOUNTING ASSEMBLY

(75) Inventors: Richard A. Nortier, Westchester, IL (US); Mario E. Semchuck, Scottsdale, AZ (US)

(73) Assignee: Sloan Valve Company, Franklin Park, IL (US)

( * ) Notice: Subject to any disclaimer, the term of this patent is extended or adjusted under 35 U.S.C. 154(b) by 12 days.

(21) Appl. No.: 10/093,309

(22) Filed: Mar. 7, 2002

(65) Prior Publication Data

US 2003/0167650 A1 Sep. 11, 2003

(51) Int. Cl.[7] ..... G01D 21/00

(52) U.S. Cl. ..... 33/645; 33/528; 33/DIG. 10; 33/613; 137/360; 4/695

(58) Field of Search ..... 33/613, 645, 452, 33/454, 456, 464, 465, 528, 529, DIG. 10; 137/343, 356, 360; 4/695, 135; 248/56, 57

(56) References Cited

U.S. PATENT DOCUMENTS 1,056,759 A * 3/1913 Mallery ..... 248/56
1,168,889 A * 1/1916 Knauber ..... 248/56
1,202,222 A * 10/1916 Quinn ..... 248/56
1,791,420 A * 2/1931 Mayo ..... 248/56
3,780,443 A * 12/1973 Smith ..... 33/613
3,847,175 A * 11/1974 Anderson ..... 137/360
3,862,433 A * 1/1975 Rousselet ..... 137/360
3,867,957 A * 2/1975 Fehrm ..... 137/360
4,410,004 A * 10/1983 Kifer et al. ..... 137/360
5,197,511 A * 3/1993 Kohn et al. ..... 137/360
5,359,820 A * 11/1994 McKay ..... 4/696
6,077,000 A * 6/2000 Gibbons et al. ..... 33/529
6,481,111 B1 * 11/2002 Myrick ..... 33/613

* cited by examiner

*Primary Examiner*—Diego Gutierrez
*Assistant Examiner*—Travis Reis
(74) *Attorney, Agent, or Firm*—Cook, Alex, McFarron, Manzo, Cummings & Mehler, Ltd.

(57) ABSTRACT

A mounting plate assembly for use in aligning electrical and plumbing components of a toilet flush valve installation includes a pair of rails having openings therein for use in attaching the assembly to wall studs of variant spacing. There is a plate with openings and fasteners on the plate and rails for variable mounting of the plate to the rails. The plate has an opening for installation of an electrical box and at least one opening for a water inlet pipe. A pipe locater is used to properly position a pipe within the plate opening. There are openings at upper and lower portions of the plate to insure its correct vertical alignment with a water drain from a toilet fixture.

10 Claims, 2 Drawing Sheets

FLUSH VALVE MOUNTING ASSEMBLY

THE FIELD OF THE INVENTION

The present invention relates to a mounting plate assembly for use in aligning electrical and plumbing components of a toilet flush valve installation. Typically, a flush valve installation which utilizes electrical sensor activation requires an electrical box, appropriately located relative to the toilet fixture drain line, and a flush valve water inlet pipe. Since at least three different trades are involved in a new construction installation, an electrician, a plumber and a drywall installer, it frequently happens that the electrical and plumbing components are not properly related relative to the openings in the drywall panel, with the end result that a portion of the installation may have to be re-worked or the components are not properly aligned for final installation of the toilet fixture. The present invention provides a simple and reliable device for insuring the appropriate relationship of the electrical and plumbing components and that these components are correctly positioned relative to the drain line for the toilet fixture.

The mounting plate assembly, which includes a plate, a pair of spaced rails and a water pipe locater, along with appropriate openings in the plate, insures that the electrical and plumbing components are all properly related to each other and to the toilet fixture drain line. This eliminates the problems normally associated with multiple trade installation of the electrical and plumbing components in new construction.

In new construction, normally the drain line will first be run, the walls will then be studded out, the plumber will return to run the water inlet, the electrician will locate the electrical connections relative to the water inlet and drain and finally, the drywall installer will place the sheet rock in position on the studs. After this the plumber will return to complete the flush valve and toilet fixture installation. Without a rigid, fixed locating device, error can be introduced at any point in any one of the trade installations. The present invention provides just such a means to avoid inappropriate installation of any components and to insure all components will be aligned and that the drywall installer will have an exact location for the openings in the drywall to fit over the plumbing and electrical components.

SUMMARY OF THE INVENTION

The present invention relates to a mounting plate assembly for use in appropriate alignment of the electrical and plumbing components of a toilet flush valve installation.

A primary purpose of the invention is to provide a mounting plate assembly for the use described which insures correct location of the electrical box and the water inlet pipe relative to the drain line of the toilet fixture.

Another purpose of the invention is to provide such an assembly which may be useful for right-hand or left-hand installation and for wall studs with variant spacing therebetween.

Another purpose of the invention is to provide an assembly of the type described which insures location of the mounting plate directly over the toilet fixture drain line and plumb-bob vertical disposition of the mounting plate.

Another purpose of the invention is to provide a simply constructed and reliable mounting plate assembly for the use described.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The present invention allows installation of a toilet fixture flush valve in a plumb and level manner, provides a sturdy mounting point for the incoming water supply, maintains the correct relative position between the water inlet, the electrical box location for the sensor and electrical connections, and identifies the toilet fixture drain as the center point for the installation. It provides for positioning anywhere between wall studs on 16" or 24" center-to-center spans through the use of two mounting rails having slots for variable positioning of the rails on the studs. The general purpose of the mounting plate assembly is to insure that the electronic package, the water inlet, and fixture water outlet are properly located relative to each other. This overcomes the problems associated with multiple trade installation at multiple points in time.

In a typical new construction installation, the drain line will first be run, the walls will then be studded out, the plumber will return to run the water inlet, the electrician will locate the electrical connections relative to the water inlet and drain, the drywall installer will then install the sheet rock to finish the wall, and finally, the plumber will return to complete the flush valve installation. Without a rigid, fixed locating means, substantial error can be introduced at any point that a different tradesman comes on the job. If the installation is not plumb and level, the electrical connections are more difficult to install and thus can be susceptible to vandalism.

Figure 1:
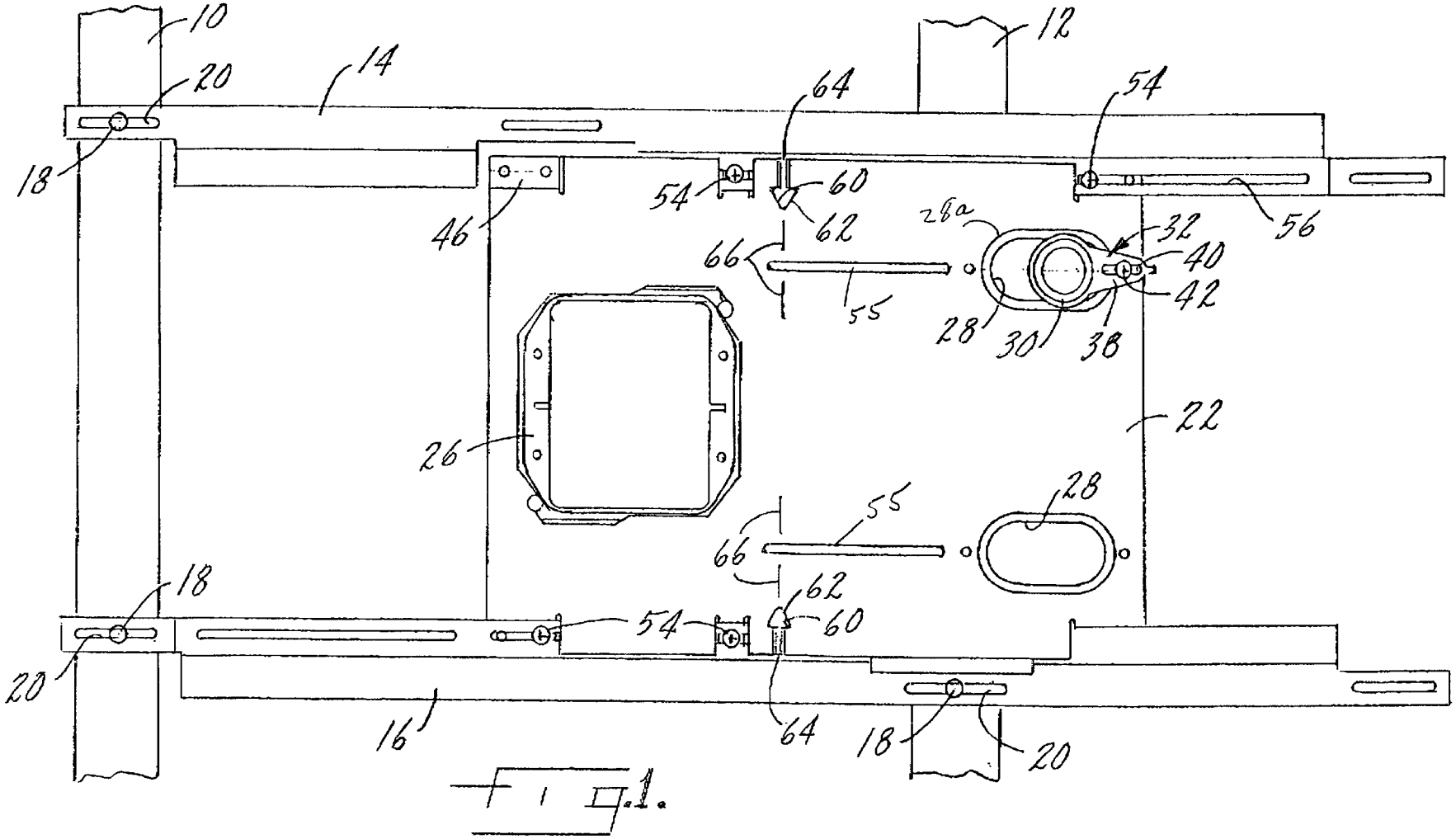
FIG. 1 is a front view of the mounting plate assembly fastened to a pair of spaced wall studs.
Figure 2:
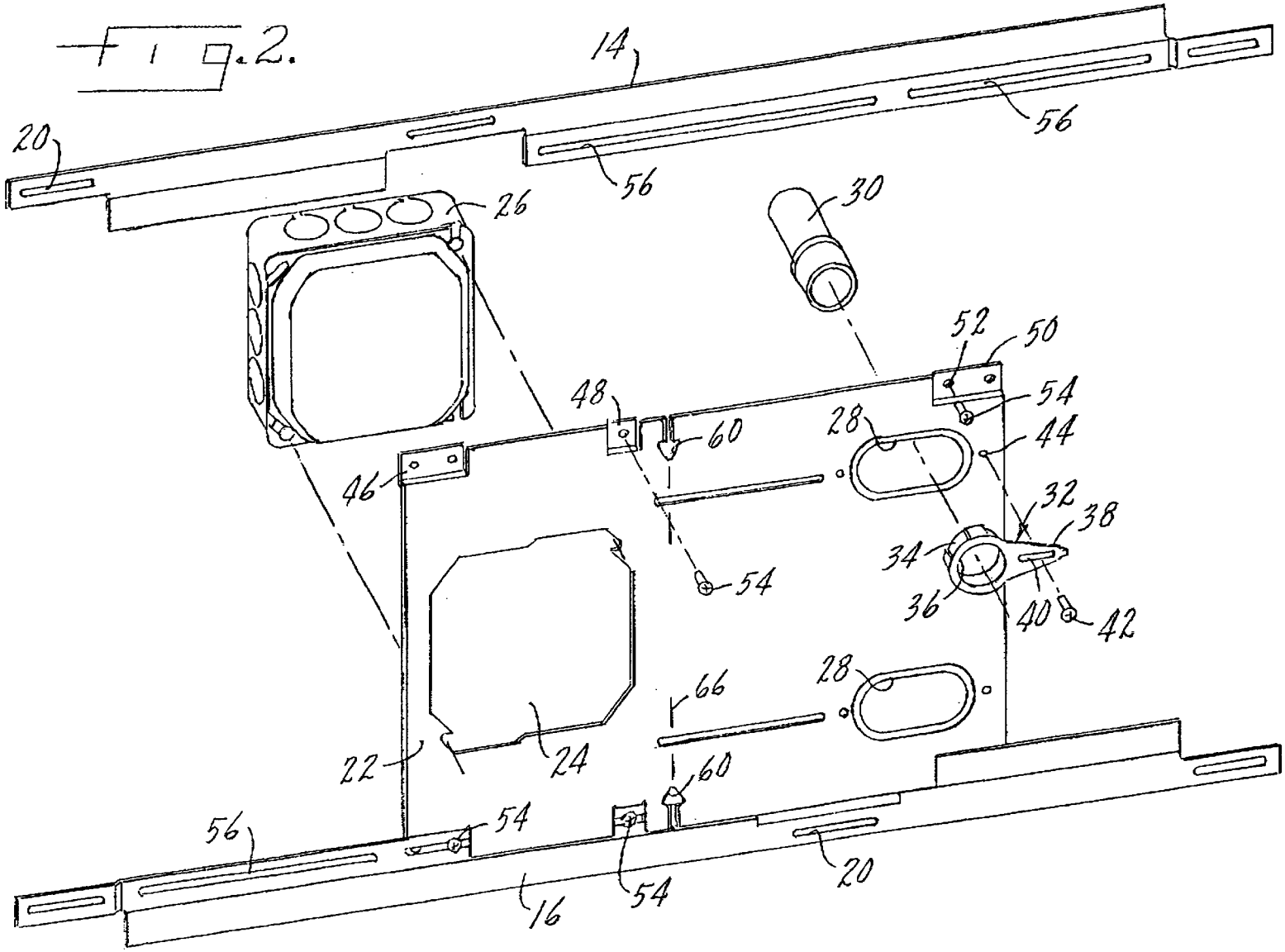
FIG. 2 is an exploded perspective of the mounting plate assembly of FIG. 1.

In FIG. 1, a pair of wall studs are indicated at 10 and 12. Rails 14 and 16 are attached to the wall studs by fasteners 18 which pass through elongated slots 20 in the rails. The slots 20 are so located on the rails, as shown in FIG. 2, as to accommodate wall studs which may be either 16" or 24" on center. As particularly shown in FIG. 2, the rails 14,16 are identical and will be positioned in a symmetrical relationship with each other when mounted to the wall studs.

A mounting plate is indicated at 22 and will have an opening 24 for location of an electrical box 26. The plate 22 further has two oval-shaped openings 28, each of which is used for the installation of a water pipe 30. Only one such opening will be used in a specific location, but by having two openings, and located as shown on the plate 22, the plate may be used for either a right-hand or left-hand installation of the water pipe. Each opening is surrounded by a breakaway spacer 28*a* which allows the openings to accommodate either ¾" or 1" copper pipe, with the spacer being removed for the larger size pipe.

A pipe locater is indicated at 32 and will have a sleeve 34 which will extend over the pipe 30, with the pipe passing through an opening 36 in the locater. The locater 32 has a triangular-shaped arm 38 with an elongated slot 40 which will accept a fastener 42 which will then pass through an opening 44 in the mounting plate 22. The elongated slot 40 and the oval openings provide for variable location of the water pipe. The locater will first be slipped over the water pipe 30 and will then be fastened to the plate 22 by use of a fastener 42, the elongated slot 40 and the opening 44 in the mounting plate.

As shown in FIG. 2, the mounting plate has laterally offset mounting tabs 46, 48 and 50 at the upper and lower sides of the plate. Each of these tabs has openings 52 for use in receiving fasteners 54. The fasteners will pass through elongated slots 56 in the mounting rails 14 and 16. This permits variable positioning of the plate between the studs 10 and 12 and on the rails 14 and 16. It is important that the plate 22 be properly positioned relative to the drain line and the location of the tabs 46, 48 and 50 and their associated mounting holes and the elongated slots 56 in the rails permit variable positioning of the plate to the rails between the studs. As particularly shown in FIG. 2, the tabs will be located behind the rails with the fasteners 54 extending from the front of the plate, through the rails, and then into the holes or openings in the tabs. The openings in the tabs may be appropriately threaded if desired, or self-tapping fasteners may be used.

Plate 22 has two horizontal slots 55, offset from the centerline of the plate, which slots are used to mount the plate directly to a wall stud in the event the plate straddles the studs. In this instance, no rails would be required.

It is important that the mounting plate be both vertically aligned with the drain line and be plumb. To this end, upper and lower edges of the mounting plate have arrow-shaped openings 60, with each such opening having a head portion 62 and a shank portion 64. The lower arrow-shaped opening, when the plate is installed, will be located directly over the drain line. A plumb-bob will be placed in the upper opening and when the plumb-bob line passes from the upper opening, in alignment with score lines 66 and the lower opening, it is insured that the plate is plumb and is located directly over the drain line.

In the past, installations of the type shown herein used paper templates that relied heavily on installers' measurements and the discipline of the multiple trades to put each component in an appropriate location. Often this did not happen. The present assembly provides an absolutely reliable means of not only insuring that the mounting of the components is correct relative to the drain line, but that these components are in vertical alignment with the drain line and with each other. It substantially simplifies the installation of an electrical sensor-operated flush valve for use with a toilet fixture, whether it be a urinal or water closet.

In addition to the advantages described above, the mounting system provides increased flexibility for job site scheduling of the various trades. For instance, the mounting plate may be put up before the drain and then the drain located relative to the plate. Also, the mounting system could be installed by an electrician instead of the plumber. It is normally desirable that the plumber install the plate, as he has information as to location of the related plumbing fixtures, but if the plumber properly locates the water line, other trades could install the mounting system.

Whereas the preferred form of the invention has been shown and described herein, it should be realized that there may be many modifications, substitutions and alterations thereto.

The embodiments of the invention in which an exclusive property or privilege is claimed are as follows:

1. A mounting plate assembly for use in aligning electrical and plumbing components of a toilet flush valve installation between wall studs which extend in a vertical direction, said assembly including:

a pair of rails having openings therein for use in attaching the assembly to wall studs of variant spacing, a plate, cooperating means on said plate and rails for variable mounting of said plate to said rails, the mounting of said plate to said rails being variable in a direction lateral to the vertical extent of the wall studs, said plate having an opening for installation of an electrical box, said plate having at least one opening for a water pipe, a pipe locater having an opening of a size to receive a water pipe, cooperating means on said plate and locater for adjustably mounting said locater to said plate adjacent a-water-pipe said at least one opening in the plate, and means on said plate for use in vertically aligning said plate over a toilet fixture drain line.

2. The mounting plate assembly of claim 1 wherein said plate includes a pair of openings for a water pipe, said openings being spaced, relative to each other, and in said plate, to permit said plate to be used for either a right-hand or left-hand installation of a toilet flush valve.

3. The mounting plate assembly of claim 2 wherein said openings are generally oval in shape, permitting sidewise movement of a water pipe therein.

4. The mounting plate assembly of claim 2 including a breakaway spacer surrounding each opening.

5. The mounting plate assembly of claim 1 wherein said pipe locater includes a sleeve portion and an arm portion, with said arm portion having a slot for use in receiving a fastener to variably position said locater on said plate relative to said at least one opening in the plate.

6. The mounting plate assembly of claim 1 wherein said plate electrical opening is generally adjacent one side of said plate and said at least one opening in the plate is generally adjacent an opposite side of said plate.

7. The mounting plate assembly of claim 1 wherein the openings in said rails extend longitudinally of said rails to permit said rails to be mounted to wall studs of different spacing.

8. The mounting plate assembly of claim 1 wherein the cooperating means on said plate and rails for variable mounting of said plate to said rails include longitudinally extending slots in said rails and fixed openings on said plate, fasteners for passing through said plate and rail openings to mount said plate to said rails.

9. The mounting plate assembly of claim 1 further including a pair of horizontal slots in said plate for use in mounting the plate directly to a wall stud.

10. The mounting plate assembly of claim 1 wherein the means on said plate for use in vertically aligning said plate over a toilet fixture drain line include spaced openings, one adjacent an upper edge of said plate and another adjacent a lower edge of said plate, with the lower opening being formed and adapted to be positioned over a drain line, and the upper opening being formed and adapted to be useful with a plumb-bob to insure correct vertical orientation of said plate.

* * * * *